US007674070B2

(12) United States Patent
Fluent et al.

(10) Patent No.: US 7,674,070 B2
(45) Date of Patent: Mar. 9, 2010

(54) VIBRATORY SYSTEM FOR COMPACTOR VEHICLES

(75) Inventors: Chad L. Fluent, St. Thomas, PA (US); Michael J. Scotese, Carlisle, PA (US)

(73) Assignee: Volvo Construction Equipment AB, Eskilstuna (SE)

( * ) Notice: Subject to any disclaimer, the term of this patent is extended or adjusted under 35 U.S.C. 154(b) by 1080 days.

(21) Appl. No.: 10/543,345

(22) PCT Filed: Jan. 26, 2004

(86) PCT No.: PCT/US2004/002052

§ 371 (c)(1),
(2), (4) Date: Jan. 25, 2006

(87) PCT Pub. No.: WO2004/067848

PCT Pub. Date: Aug. 12, 2004

(65) Prior Publication Data

US 2006/0147265 A1 Jul. 6, 2006

Related U.S. Application Data

(60) Provisional application No. 60/442,336, filed on Jan. 24, 2003.

(51) Int. Cl.
*E01C 3/06* (2006.01)

(52) U.S. Cl. ..... 404/122; 404/83

(58) Field of Classification Search ..... 404/83–84.1, 404/102, 103, 113, 117, 122
See application file for complete search history.

(56) References Cited

U.S. PATENT DOCUMENTS

| | | | | |
|---|---|---|---|---|
| 4,143,737 | A * | 3/1979 | Erich, Jr. | 181/121 |
| 5,695,298 | A | 12/1997 | Sandstrom | |
| 5,727,900 | A | 3/1998 | Sandstrom | |
| 6,241,420 | B1 | 6/2001 | Perrin et al. | |

FOREIGN PATENT DOCUMENTS

| | | |
|---|---|---|
| DE | 197 12 580 | 10/1998 |
| WO | WO 00/05454 | 2/2000 |
| WO | WO 01/81680 | 11/2001 |

* cited by examiner

*Primary Examiner*—Raymond W Addie
(74) *Attorney, Agent, or Firm*—Michael Best & Friedrich LLP

(57) ABSTRACT

The present invention is directed to a control system for sensing the vibration amplitude on a vibration compacting machine. In addition, the control system modifies the rotational speed of the eccentric assembly based on the vibration amplitude of the eccentric assembly. In one embodiment, the control system modifies the rotational speed of the eccentric assembly to match the optimum speed for the adjusted vibration amplitude when the eccentric assembly is adjusted to increase or decrease the vibration amplitude. Reducing the rotational speed of the eccentric assembly at high vibration amplitudes minimizes wear to each of the load bearing components in the vibration compacting machine resulting in an extended service life for the vibration compacting machine. Similarly, increasing the rotational speed of the eccentric assembly at low vibration amplitudes increases the effectiveness of the vibration compacting machine.

20 Claims, 10 Drawing Sheets

VIBRATORY SYSTEM FOR COMPACTOR VEHICLES

This application claims priority to U.S. Provisional Application Ser. No. 60/442,336, filed Jan. 24, 2003, the entire contents of which are incorporated herein by reference.

BACKGROUND AND FIELD OF THE INVENTION

This invention relates to compacting vehicles, and more particularly to vibration mechanisms for such compacting vehicles.

Compacting vehicles are generally known and are basically used to compact paved or unpaved ground or "work" surfaces (e.g., asphalt mats, roadway base surfaces, etc.). A typical compacting vehicle includes a frame and one or two vibrating drums rotatably mounted to the frame, the drums compacting the surfaces as the vehicle passes over. Compacting vehicles often include vibration assemblies that generate vibrations and transfer these vibrations through the drum to the work surface. Such vibration assemblies typically include two or more eccentric weights that are adjustable relative to each other in order to vary the amplitude of the vibrations that are generated by rotating the eccentric assembly.

SUMMARY OF THE INVENTION

In one aspect, the present invention is a vibratory system for a compacting vehicle that includes a frame and at least one compacting drum rotatably connected with the frame. The vibratory system comprises first and second weights each disposed within the drum so as to be rotatable about an axis, at least one of the two weights being adjustably positionable about the axis so as to vary a value of a spacing angle between the two weights. A motor is configured to rotate the first and second weights about the axis. A sensor is configured to sense at least one of the first and second weights. Further, a controller is coupled with the sensor and is configured to determine the value of the spacing angle. The controller is further configured to operate the motor such that the motor rotates the two weights at a rotational speed having a value that is generally directly proportional to the value of the spacing distance.

In another aspect, the present invention is a control system for a vibratory mechanism of a compacting vehicle. The vibratory mechanism includes first and second rotatable members and an actuator configured to rotate the members. The control system comprises a sensor configured to sense an spacing angle between the first and second rotatable members and a controller. The controller is coupled with the sensor and is configured to automatically operate the actuator such that the two members rotate at about a first rotational speed when the spacing distance has a first value and alternatively the two members generally rotate at about a second rotational speed when the spacing distance has a second value. The first distance is greater than the second distance and the first speed is greater than the second speed.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown.

In the drawings.

DETAILED DESCRIPTION OF THE INVENTION

Figure 1:
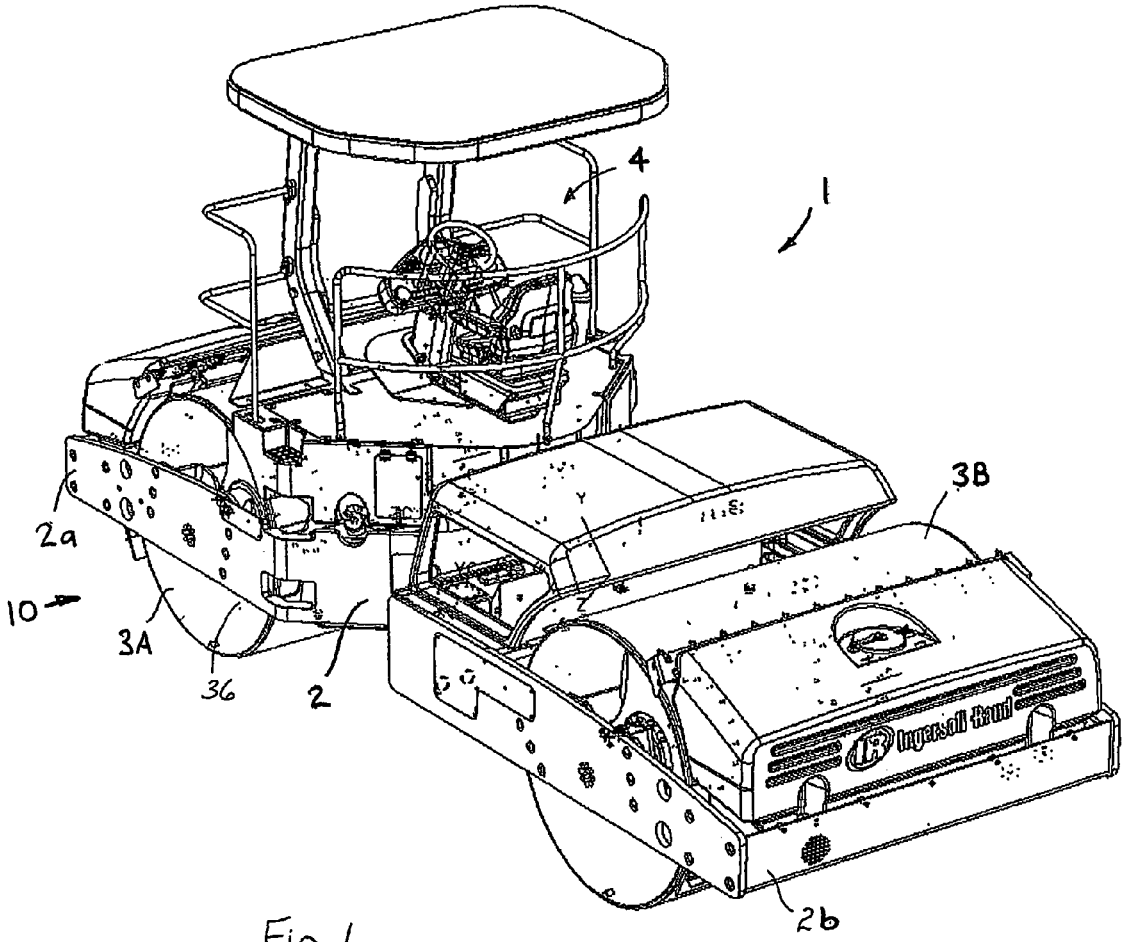
FIG. 1 is a perspective view of a compacting vehicle including a vibratory system and related control system in accordance with the present invention.

Certain terminology is used in the following description for convenience only and is not limiting. The words "inner", "inwardly" and "outer", "outwardly" refer to directions toward and away from, respectively, a designated centerline or axis, or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words or similar import.

Referring now to the drawings in detail, wherein like numbers are used to indicate like elements throughout, there is shown in FIGS. 1-12 a presently preferred embodiment of a control system 10 for a vibratory mechanism or system 12 for a compacting vehicle 1 in accordance with the present invention. The compacting vehicle 1 basically includes a frame 2 and at least one and preferably two compacting drums 3A, 3B rotatably connected with the frame 2. The vibratory system 12 basically comprises first and second rotatable members or weights 14, 16 each disposed within one of the drums 3 so as to be rotatable about an axis 15 and forming an eccentric assembly 17, as described in further detail below. At least one of the two weights 14, 16, preferably the first weight 14, is adjustably positionable about the axis 15 so as to vary a value of a spacing angle $A_S$ between the two weights 14, 16, preferably by means of an adjustment mechanism 19. A motor 18 is configured to rotate the first and second weights 14, 16 about the axis 15, alternatively in either a counterclockwise or clockwise direction, such that vibrations are generated by the rotating weights 14, 16, as discussed below. The amplitude of the vibrations generated by the rotating weights 14, 16 is basically inversely proportional to the value of the spacing angle $A_S$, i.e., the greater the spacing angle $A_S$, the lesser the net eccentric moment of the weights 14, 16 and the lesser the vibration amplitude, and vice-versa, as described in further detail below.

The control system 10 basically comprises a sensor 20 configured to sense at least one of the first and second weights 14, 16 and a controller 22 coupled with the sensor 20. The controller 20 is preferably configured to determine the value of the spacing angle $A_S$ from information provided by the sensor 20, as discussed below. The controller 22 is further configured to automatically operate or adjust the motor 18 such that the motor 18 rotates the two weights 14, 16 at a rotational speed $R_S$ having a value that is generally directly proportional to the value of the spacing angle $A_S$. In other words, the controller 22 is configured to operate the motor 18 such that the motor 18 rotates the two weights 14, 16 at about a first, substantially greater rotational speed $R_{S1}$ (e.g., 4200 rpm) when the spacing angle $A_S$ has a first, relatively greater value $A_{S1}$ (e.g., 180 degrees). Alternatively, the controller 22 operates the motor 18 such that the motor 18 rotates the two weights 14, 16 at about a second, substantially lesser rotational speed $R_{S2}$ (e.g., 2500 rpm) when the spacing angle has a second, relatively lesser value $A_{S2}$ (e.g., 0 degrees). As such, the weights 14, 16 are rotated at a higher speed when the vibration amplitude is lesser and the weights 14, 16 are rotated at a lower speed when the vibration amplitude is greater.

Preferably, the sensor 20 is configured to sense when one of the first and second weights 14, 16 is disposed (i.e., momentarily during rotation) at a particular angular position $P_A$ (FIG. 9) about the axis 15 and to generate a signal. Alternatively, the sensor 20 may be configured to directly sense or measure the spacing angle $A_S$ between the two weights 14, 16. The controller 22 is configured to determine the value of the spacing angle $A_S$ using the signal(s) from the preferred sensor 20. More specifically, the sensor 20 is configured to generate one signal when the first weight 14 is temporarily located or disposed at the angular position $P_A$ and another signal when the second weight is temporarily disposed at the angular position $P_A$. In other words, the sensor 20 generate the signals whenever the sensor 20 detects the weights 14, 16 as they pass through the angular position $P_A$ when rotating about the axis 15. The controller 22 also determines the rotational speed of the two weights 14, 16 from one of the two signals, preferably the signal generated when the sensor 20 detects the first weight 14, based upon at least two signals generated by detecting the weight 14 twice as it rotates about the axis 15, as described in further detail below. Alternatively, the control system 20 may have any another device to measure rotational speed of the weights 14, 16, such as a sensor directly measuring motor shaft speed. Based on the frequency of detecting the two weights 14, 16, the controller 22 is able to calculate the spacing angle $A_S$, as is also discussed further below.

Further, the control system 10 preferably further comprises a first reference member 24 connected with the first weight 14 and a second reference member 26 connected with the second weight 16. The sensor 20 is located at a fixed location on the vehicle 1 with respect to the axis 15 and is configured to generate a signal when either one of the two reference members 24, 26 is disposed generally proximal to the fixed location $P_A$ as the weights 14, 16 rotate past the sensor 20. Preferably, each one of the first and second reference members 24, 26 is a magnet 60, 62, respectively, and the sensor 20 is a proximity sensor 66 configured to sense the two magnets 60, 62.

Furthermore, the controller 22 preferably includes a microprocessor 72 electrically coupled with the sensor 20 and with the motor 18. The microprocessor 72 has a memory and a reference table stored in the memory, the reference table including a plurality of speed values each corresponding to a separate value of the spacing angle $A_S$. With this arrangement, the microprocessor 72 is configured to select a desired speed value from the reference table based on the sensed spacing angle $A_S$, and to adjust the motor 18 accordingly. In addition, the vibratory system 10 preferably further comprises a pump 5 operatively coupled with the motor 18, with the controller 22 being operatively connected with the pump 5. The controller 22 is further configured to adjust the pump 5 so as to thereby adjust rotational speed of the motor 18, and thus the weights 14, 16. Having discussed the basic components and operation of the present invention, these and other elements of the control system 10 and the vibratory system 12 are described in further detail below.

Referring first to FIG. 1, the vibratory system 12 is preferably used with a compacting vehicle 1 that includes a frame 2, a leading drum 3A, and a trailing drum 3B, but may alternatively be used with single drum compacting vehicles (not shown). The leading drum 3A is rotatably mounted to the forward end 2*a* of the frame 2 and the trailing drum 3B is rotatably mounted to the rearward end 2*b* of the frame 2. The compacting vehicle 1 also includes an operator's station 4 that is connected to the frame 2 at a position substantially above and between the leading and trailing drums 3A, 3B such that an operator located in the operator's station 4 is sufficiently elevated above the compacting vehicle 1 to view the area ahead of the leading drum 3A.

Figure 2:
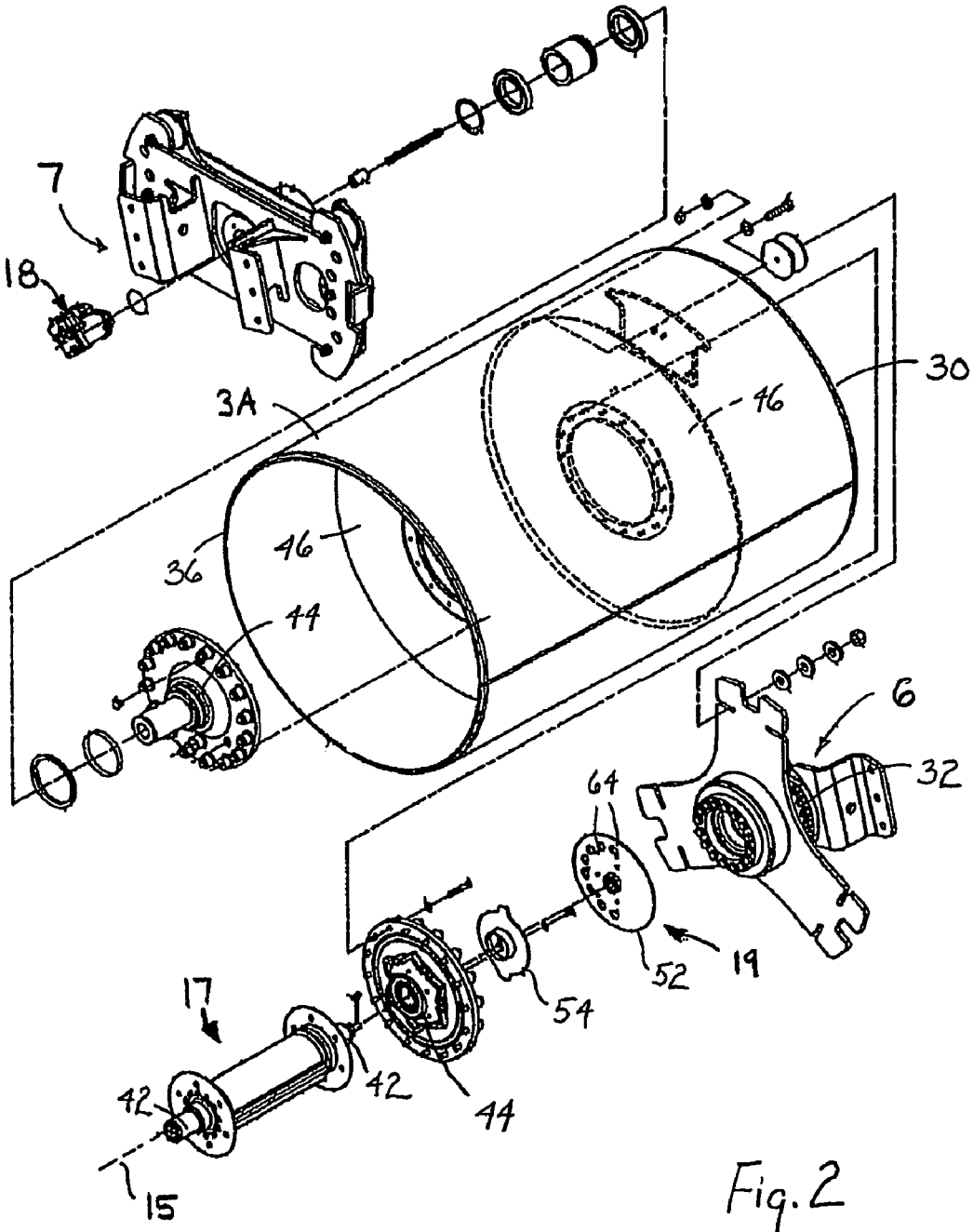
FIG. 2 is an exploded perspective view of a drum assembly of the compacting vehicle shown in FIG. 1.
Figure 3:
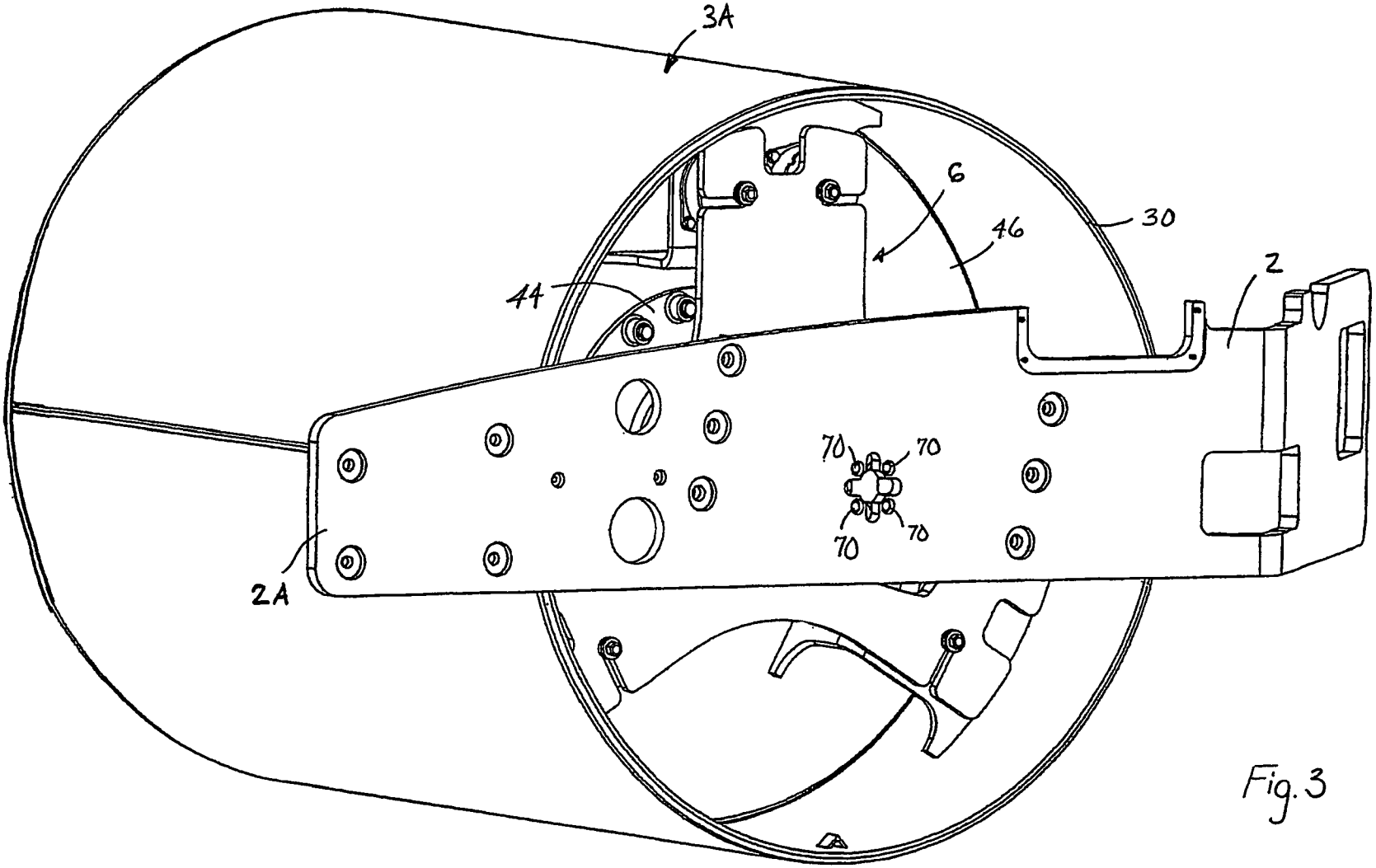
FIG. 3 is a perspective view of the drum assembly shown in FIG. 2.
Figure 4:
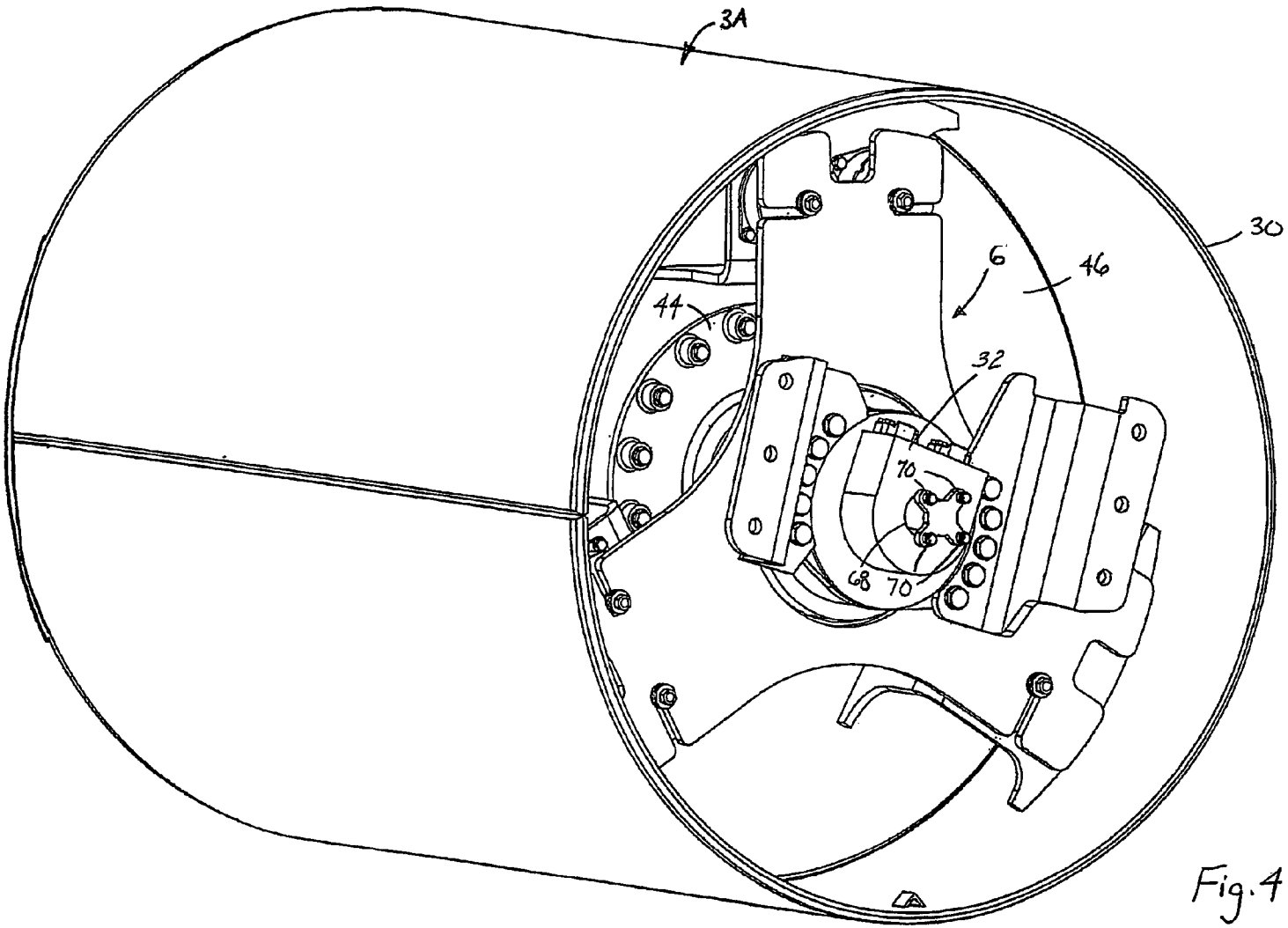
FIG. 4 is view similar to FIG. 3, illustrating the drum assembly with the frame removed.

The leading and trailing drums 3A, 3B are substantially similar, with each drum 3A, 3B having a separate eccentric assembly 17 including the two weights 14, 16, as described above and in further detail below. For simplicity's sake, only the leading drum 3A and the associated eccentric assembly 17 is described in detail herein. As best shown in FIG. 2, the drum 3A includes one eccentric assembly 17 that is mounted for rotation about the axis 15, which extends laterally or transversely through the drum 3A. Rotating the eccentric assembly 17 creates eccentric moments that cause vibrations that are transferred to the drum 3A. The drum 3A transfers these vibrations to the ground in order to level paved and unpaved surfaces.

The compacting vehicle 1 includes an engine (not shown) that is mounted to the frame 2. The engine drives two hydraulic pumps 5 that are also mounted to the frame 2. The first hydraulic pump (not shown) is operably connected to a drive assembly 6 that is connected to one side 30 of the drum 3A in a conventional manner. The drive assembly 6 includes a hydraulic motor 32 that operates to rotate the drum 3A relative to the frame 2 to thereby move the compacting vehicle 1 over the ground. The second hydraulic pump 5 (FIG. 12) is operably connected to a drive assembly 7 that is connected to another side 36 of the drum 3A in a conventional manner. The drive assembly 7 includes the hydraulic motor 18 that rotates the eccentric assembly 17, and thus the first and second weights 14, 16, relative to the drum 3A. The second hydraulic pump 5 includes an electronic displacement control 40 ("EDC") (FIG. 12) that adjusts the flow of hydraulic fluid from the second hydraulic pump 5 to the hydraulic motor 18 rotating the drive assembly 7.

The eccentric assembly 17 further includes a shaft 42 that is mounted at each end to bearings 44. The bearings 44 are secured to parallel supports 46 that extend across the inner diameter of the drum 3A. The supports 46 are welded to an interior wall of the drum 3A and are generally perpendicular to the longitudinal axis of the drum 3A.

Figure 9:
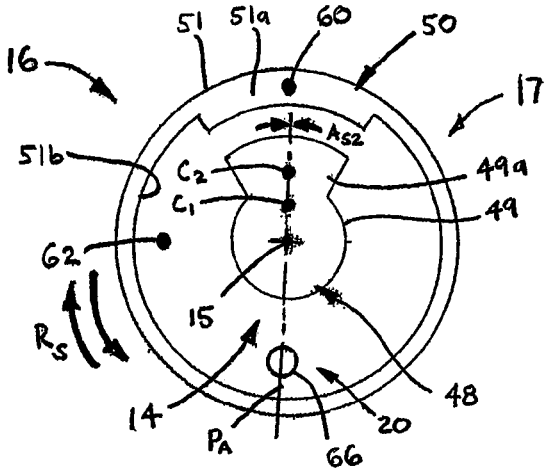
FIGS. 9-11 are schematic views of the eccentric assembly shown in FIG. 2, illustrating the relative positions of the inner and outer eccentric weights corresponding to the maximum, intermediate, and minimum vibration amplitudes.
Figure 10:
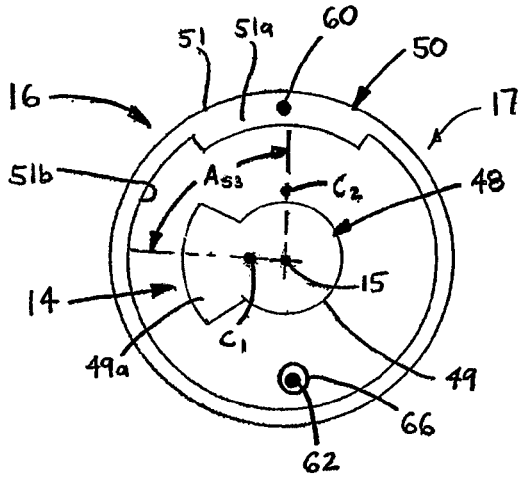
Figure 11:
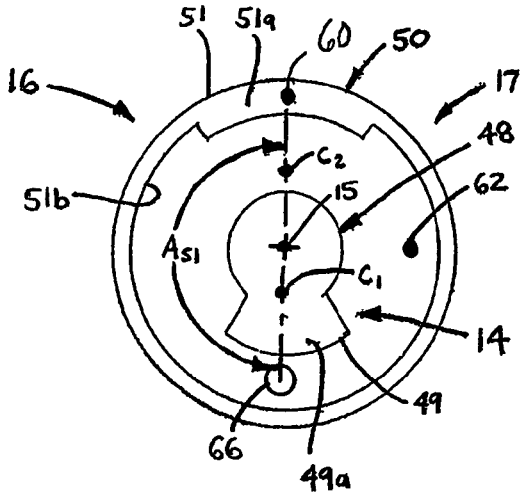

Referring to FIGS. 9-11, the two weights 14, 16 of the eccentric assembly 17 are preferably formed as inner weight 48 and an outer weight 50, respectively. The inner weight 48 has a generally solid, cylindrical body 49 with an offset portion 49*a* extending radially outwardly from a remainder of the body 49. The outer weight 50 has a generally tubular body 51 with an offset portion 51*a* extending radially inwardly from a remainder of the body 51 and having a longitudinal central bore 51*b*. The inner weight 48 is disposed within the central bore 51*b* of the outer weight 50 such that the two weights 48, 50 are radially spaced apart, the two weights 48, 50 being releasably connectable so as to be rotatable about the axis 15 as a single unit (i.e., without relative angular displacement). Alternatively, the first and second weights 14, 16 may be formed in any other appropriate manner, such as for example, two axially spaced-apart weighted members and/or having other appropriate shapes, and/or may include three or more weights (no alternatives shown).

In addition, the inner weight 48 is preferably adjustably positionable, specifically angularly displaceable, relative to the outer weight 50 so as to adjust or vary the vibration amplitude of the eccentric assembly 17. More specifically, the net moment of eccentricity of the two rotating weights 48, 50 is varied or adjusted by adjusting the relative position of the center of mass $C_1$ of the inner weight 48 with respect to the center of mass $C_2$ of the outer weight 50, as indicated in FIGS. 9-11. For purposes of illustration, each weight 48, 50 may be considered as having a centerline 48*a*, 50*a*, respectively, extending perpendicularly between the center of mass $C_1$, $C_2$, and the axis of rotation 15. As such, the spacing angle As between the two weights 48, 50 is preferably defined as the angle between the two centerlines 48*a*, 50*a* of the inner weight and outer weights 48, 50, respectively. For example, FIG. 9 illustrates a relative arrangement of the weights 48, 50 that results in a maximum vibration amplitude of the eccentric assembly 17. At the maximum amplitude arrangement, the center of mass $C_1$, $C_2$ of two weights 48, 50 are generally radially aligned with each other such that the spacing angle $A_{S2}$ is about 0 degrees. In contrast, FIG. 11 depicts a weight arrangement that results in minimum vibration amplitude of the eccentric assembly 17. At the minimum amplitude setting, the centers of mass $C_1$, $C_2$ of the two weights 48, 50 are offset by a spacing angle $A_{S1}$ of about 180 degrees. Further, FIG. 10 illustrates an intermediate vibration amplitude of the eccentric assembly 17 where the spacing angle $A_{S3}$ between the inner and outer weights 48, 50 has a value between 0 and 180 degrees.

Figure 5:
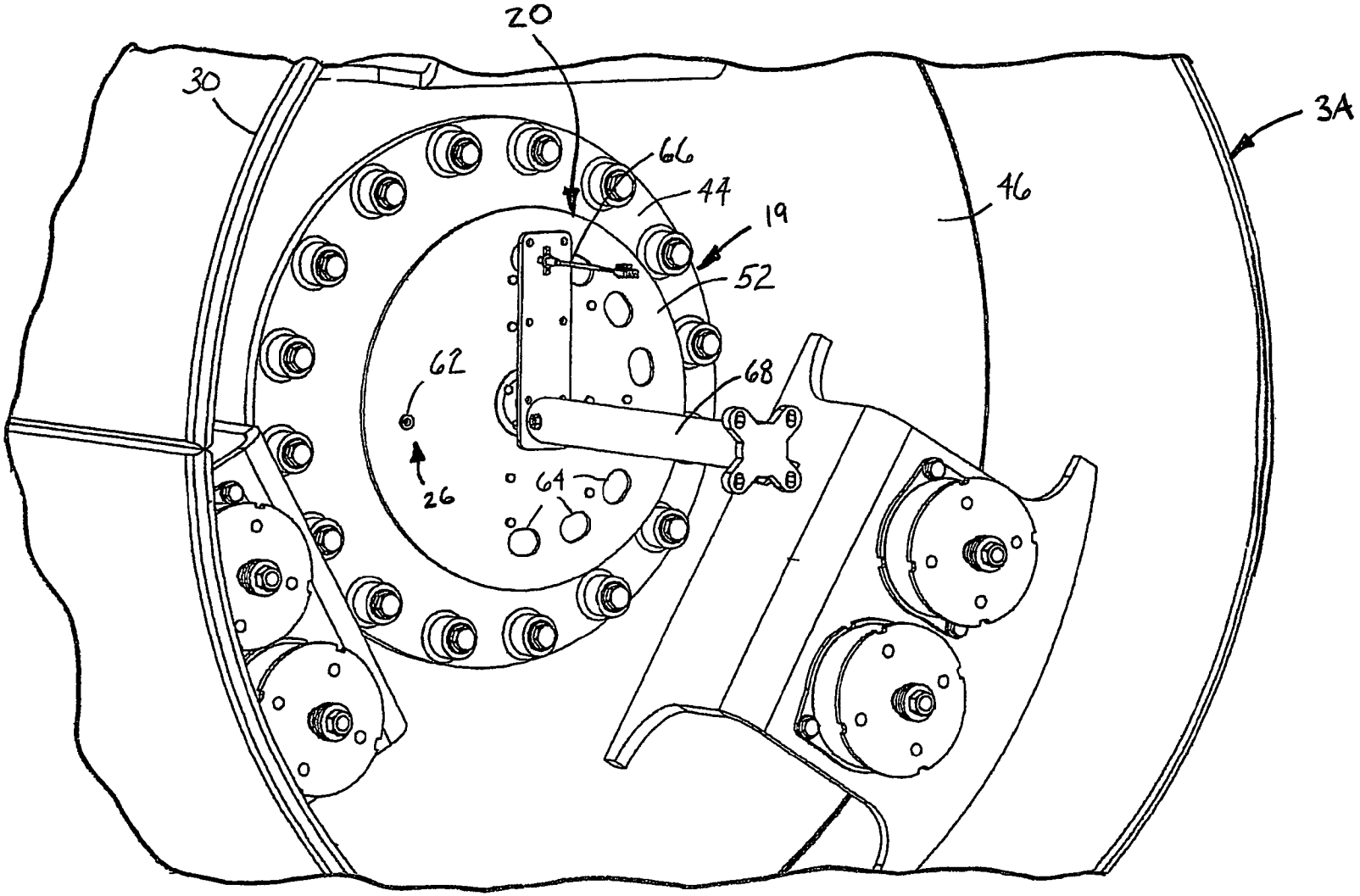
FIG. 5 is view similar to FIG. 4, illustrating the drum assembly with the drive assembly removed.
Figure 6:
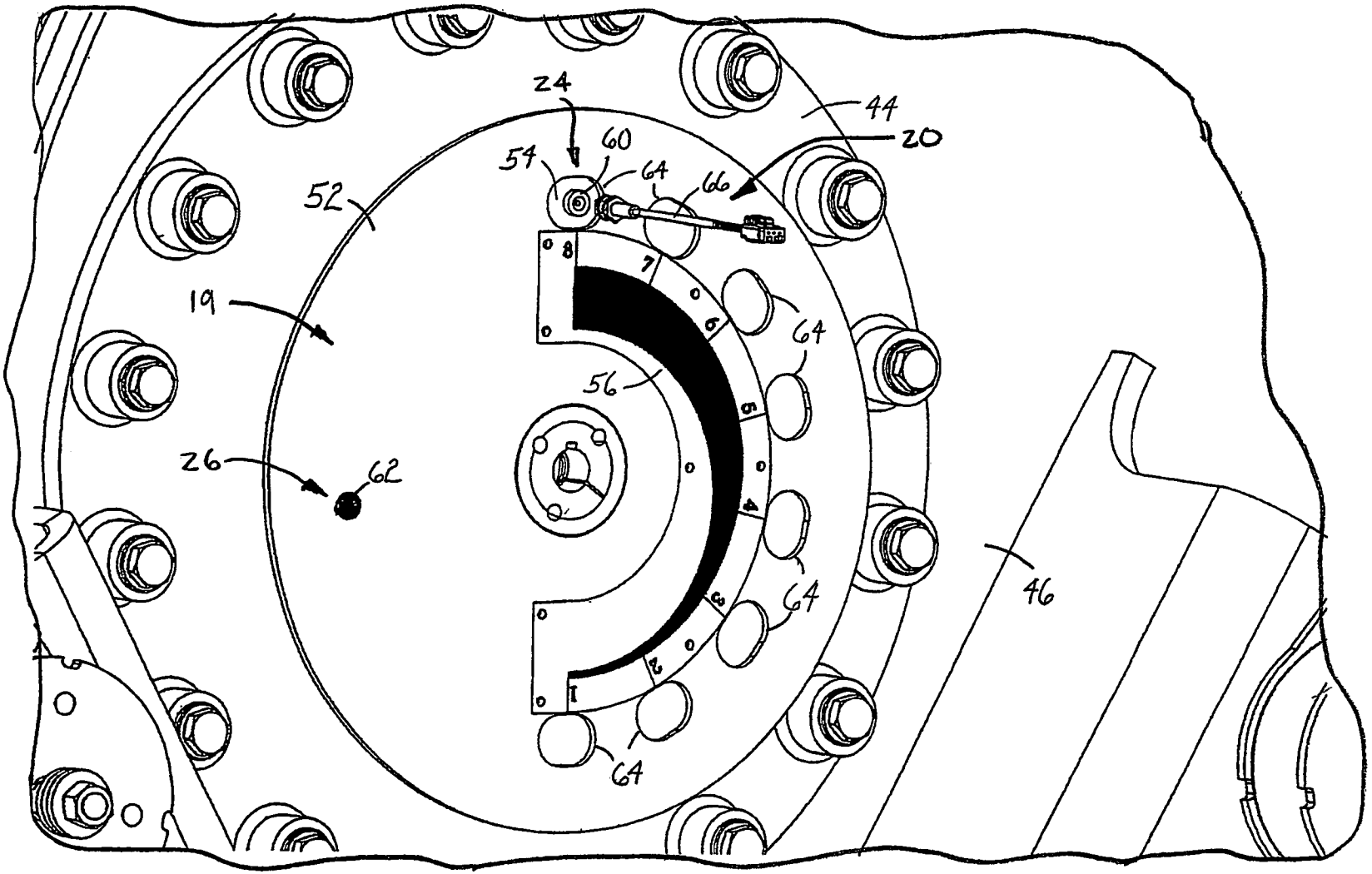
FIG. 6 is view similar to FIG. 5, illustrating the drum assembly with the support shaft removed.
Figure 7:
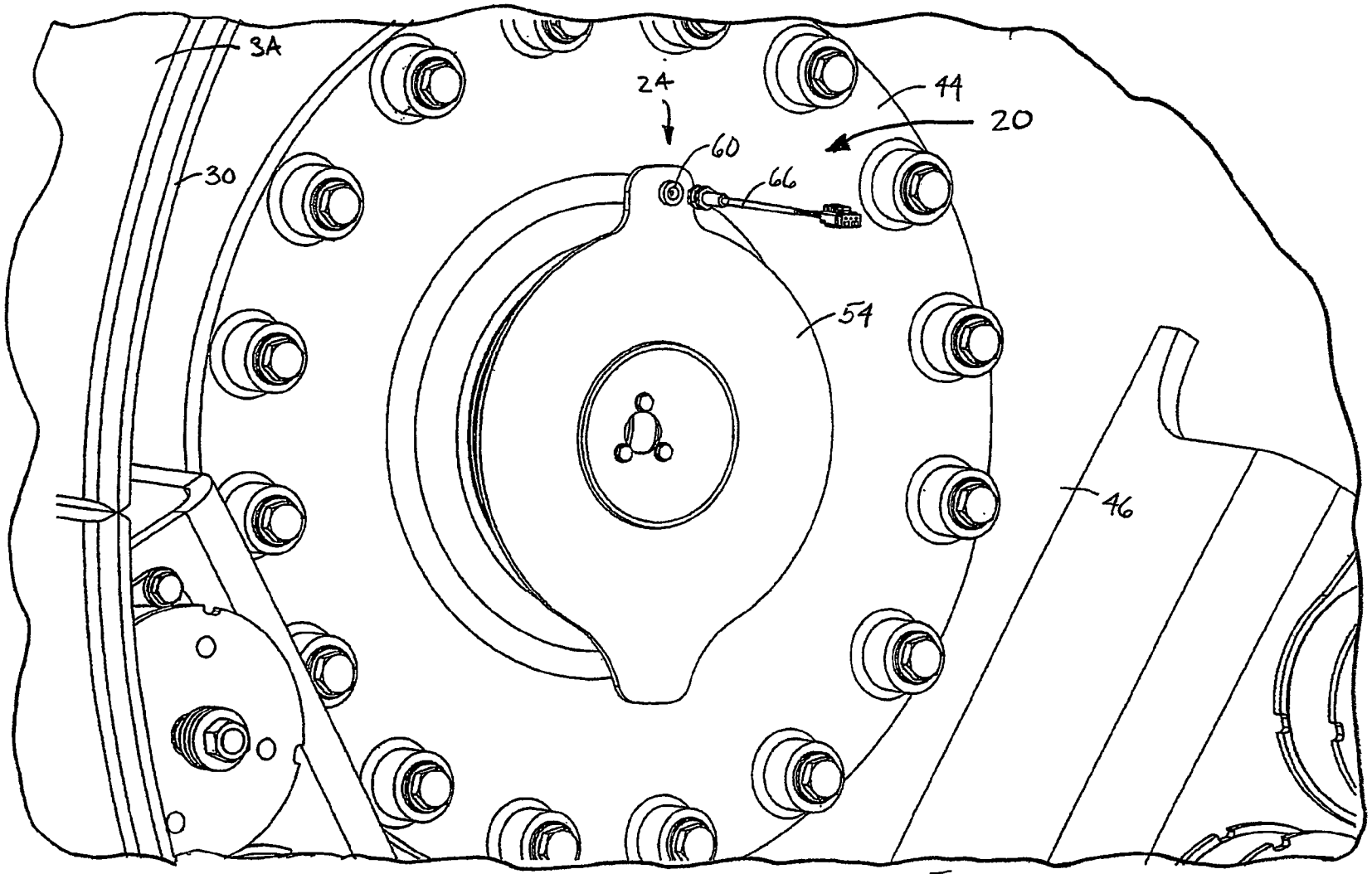
FIG. 7 is view similar to FIG. 6, illustrating the drum assembly with the hand wheel removed.
Figure 8:
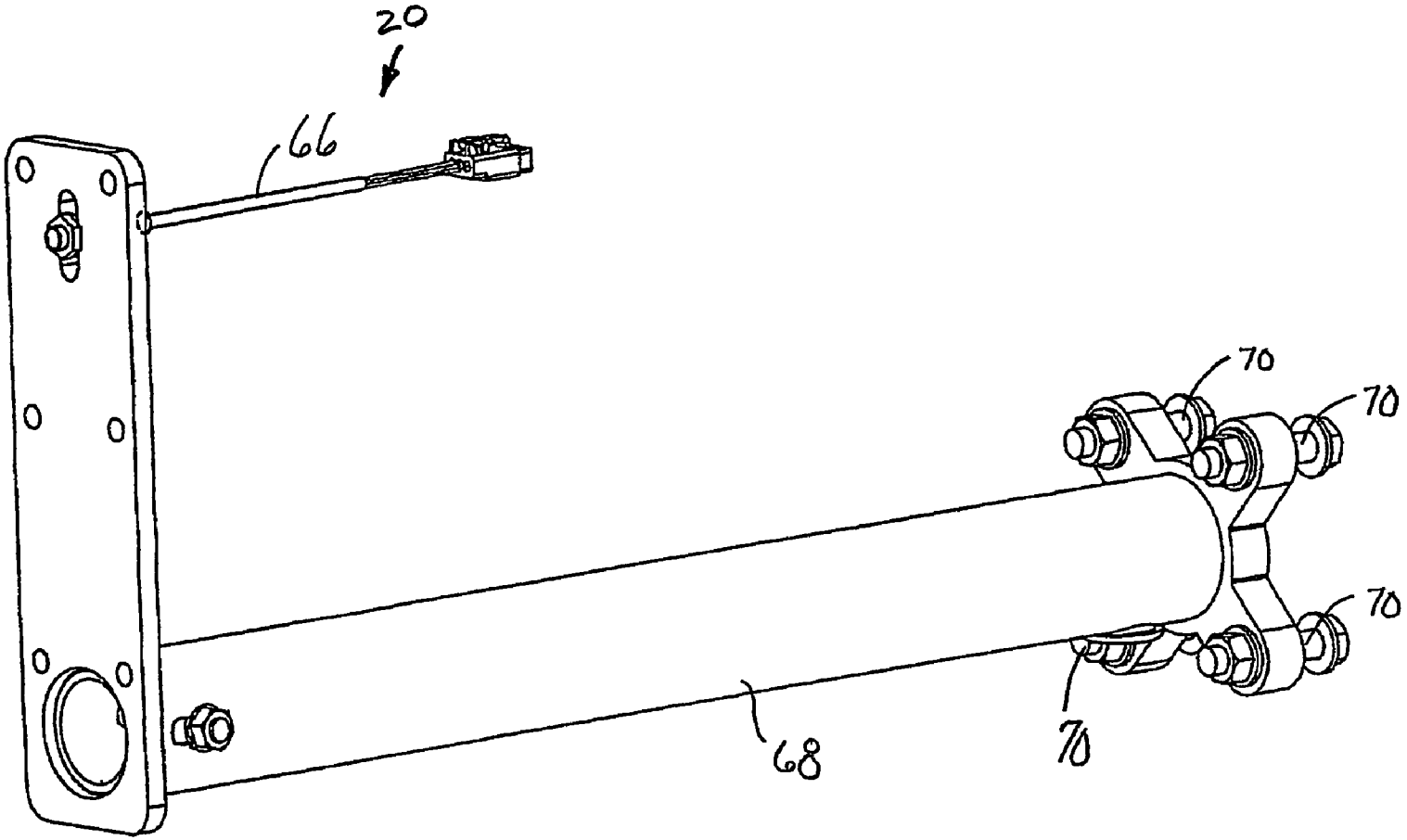
FIG. 8 is a perspective view of the support shaft shown in FIG. 5.

Referring to FIGS. 2, 5 and 6, the adjustment mechanism 19, as discussed above, preferably includes a hand wheel 52 coupled with the eccentric assembly 17 and configured to angularly displace the inner weight 48 with respect to the outer weight 50. When it is desired to adjust the vibration amplitude of the vibratory system 12, the hand wheel 52 is pulled against a spring bias to disengage the inner weight 48 from a splined connection (not shown) with the outer weight 50. With the inner weight 48 disengaged, the hand wheel 52 can be rotated to move the inner weight 48 relative to the outer weight 50 to a desired position. The position of the inner weight 48 relative to the outer weight 50 is identified by the location of the hand wheel 52 relative to an indicator 54 that is connected to the outer weight 50 (FIG. 7). The hand wheel 52 can also include identifying indicia 56 to display to the operator the general vibration amplitude of the eccentric assembly 17 relative to the maximum (identified as "8" on indicia 56 in FIG. 6) and minimum (identified as "1" on indicia 56 in FIG. 6).

Figure 12:
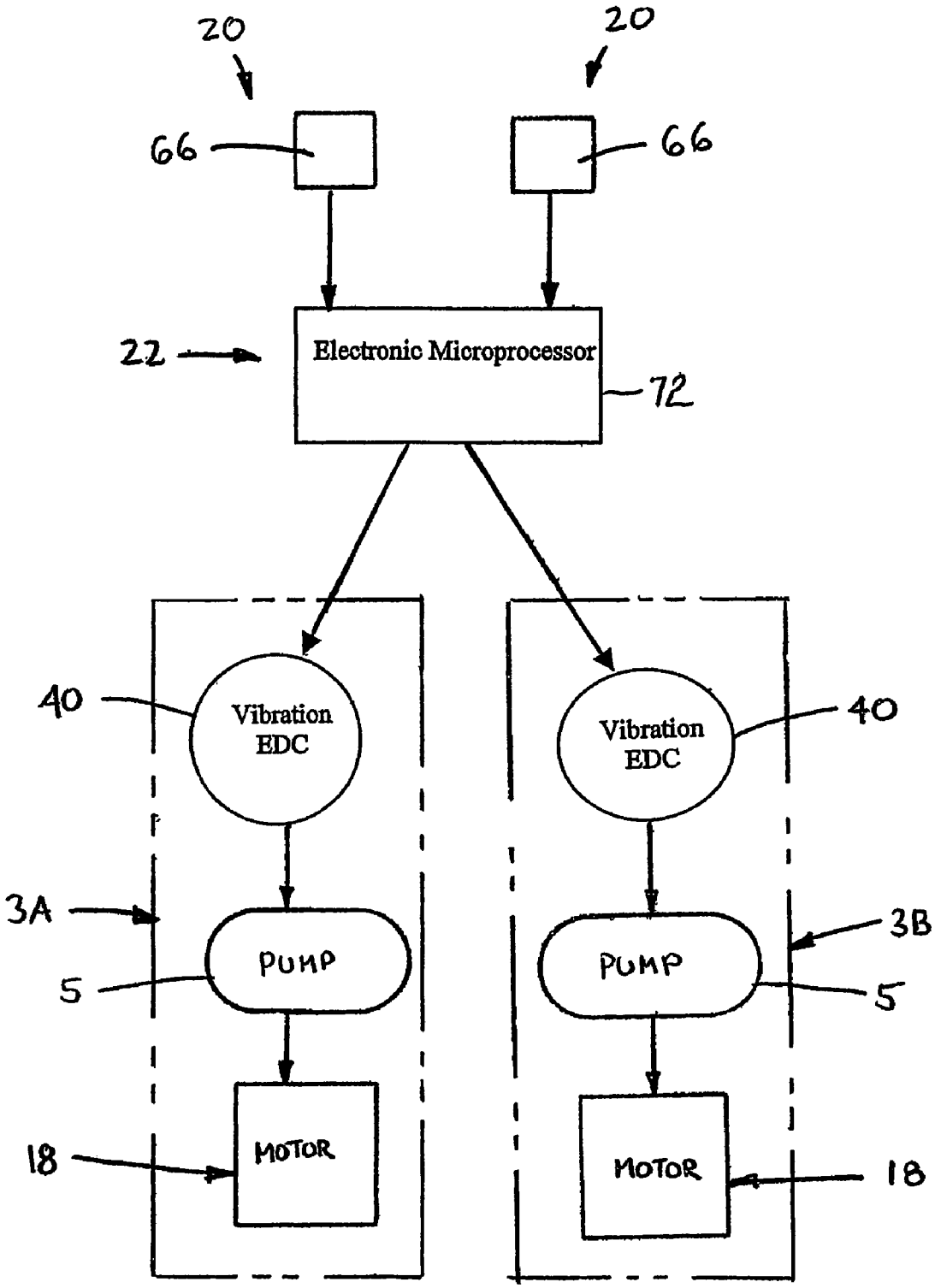
FIG. 12 is a schematic view of a control system of the compacting vehicle shown in FIG. 1.

FIG. 12 schematically illustrates the control system 10, which both senses the vibration amplitude on a compacting vehicle 1 adjusts the rotational speed $R_S$ of the eccentric assembly 17 such that the eccentric assembly 17 to rotate the eccentric assembly 17 at its optimum speed for the adjusted vibration. It is advantageous to operate the eccentric assembly 17 at optimum speeds for all adjusted vibration amplitudes because it allows the eccentric assembly 17 at lower vibration amplitudes to operate at higher speeds to improve the effectiveness of the compacting vehicle 1, and it reduces the speed of rotation for the eccentric assembly 17 at higher vibration amplitudes to minimize wear to each of the load bearing components in the compacting vehicle 1. Preferably, the controller 22 is configured to operate the motors 18 of the eccentric assemblies 17 of both drums 3A, 3B, as depicted in FIG. 12, but the vehicle 1 may alternatively be provided with two separate control systems 10, each controlling the eccentric assembly 17 of a separate one of the drums 3A, 3B.

Referring to FIGS. 6 and 9-11, the control system 10 preferably includes a first magnet 60 connected to the indicator 54 that is connected to the outer weight 50, and a second magnet 62 that is connected to the hand wheel 52 that is connected to the inner weight 48. As best shown in FIG. 6, the hand wheel 52 includes apertures 64 that correspond to each setting identified on the indicia 56. As the hand wheel 52 is rotated to each position, the corresponding aperture 64 aligns with the magnet 60. Both magnets 60, 62 are generally located at a common radial distance from the axis of rotation 15.

Referring to FIGS. 5 and 6, the sensor 20 of the control system 10 is preferably a proximity sensor 66 that is connected to the end of a support shaft 68 so as to located at the fixed angular position $P_A$ with respect to the axis 15. The support shaft 68 is connected to the frame 2 by any appropriate means, such as bolts 70, etc. As the eccentric assembly 17 rotates, the sensor 66 generates a signal each time a magnet 60, 62 passes the sensor 66. The sensor 66 generates different signals for the first and second magnets 60, 62 as the eccentric assembly rotates the magnets 60, 62 past the sensor 66. The sensor 66 senses the presence of the magnet 60 through the corresponding aperture 64, while the sensor's reading of the magnet 62 is unobstructed.

Referring again to FIG. 12, the preferred microprocessor 72 receives the signals generated by the sensor 66 and interprets the signals to determine the relative positions of the inner and outer weights 48, 50, and thereby the spacing angle $A_S$. As discussed above, the spacing angle $A_S$ is associated with a specific vibration amplitude setting for the eccentric assembly 17. Based on this calculation, the microprocessor 72 determines the optimal speed for that specific vibration amplitude, preferably by comparing the calculated value of the spacing angle $A_S$ to the stored table of speed values as discussed above, and generates and transmits a signal to the EDC 40 of the pump 5. The EDC 40 controls the flow of hydraulic fluid to the motor 18 rotating the eccentric assembly 17 thereby controlling the speed of rotation $R_S$ of the eccentric assembly 17.

The control system 10 automatically operates the motor 18 such that the eccentric assembly 17 rotates at the optimum speed based on the particular vibration amplitude of the eccentric assembly 17. In this regard, the control system 10 enables the compacting vehicle 1 to operate more efficiently because the prior machines either ran continuously at a single speed or required the operator to visually monitor the vibration amplitude setting on the hand wheel 52, determine the optimum speed of rotation for the eccentric assembly 17 based on the observed setting, and manually adjust and monitor the speed of rotation to match the optimum speed.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

We claim:

1. A vibratory system for a compacting vehicle, the vehicle including a frame and at least one compacting drum rotatably connected with the frame, the vibratory system comprising:

first and second weights each disposed within the drum so as to be rotatable about an axis, at least one of the two weights being adjustably positionable about the axis so as to vary a value of a spacing angle between the two weights;

a motor configured to rotate the first and second weights about the axis;

a sensor configured to sense at least one of the first and second weights; and a controller coupled with the sensor and configured to operate the motor, the controller operating the motor to rotate the two weights at a rotational speed having a value that is generally directly proportional to the value of the spacing angle.

2. The vibratory system as recited in claim 1 wherein the controller operates the motor to rotate the two weights at about a first rotational speed when the spacing angle has a first value and alternatively to rotate the two members at about a second rotational speed when the spacing angle has a second value.

3. The vibratory system as recited in claim 2 wherein the first angular value is substantially greater than the second angular value and the first rotational speed is substantially greater than the second rotational speed.

4. The vibratory system as recited in claim 1 wherein the sensor is configured to sense when one of the first and second weights is disposed at a particular angular position about the axis and to generate a corresponding signal and the controller is configured to determine the value of the spacing angle using the signal.

5. The vibratory system as recited in claim 4 wherein:

the sensor is configured to generate one signal when the first weight is disposed at the angular position and another signal when the second weight is disposed at the angular position; and the controller is configured to determine the spacing angle using the two signals.

6. The vibratory system as recited in claim 5 wherein the controller determines the rotational speed of the weights from one of the two signals.

7. The vibratory system as recited in claim 4 wherein the sensor generates the signal when each one of the weights is separately disposed at the angular position such that the controller compares the signals to determine the spacing angle.

8. The vibratory system as recited in claim 4 wherein the controller includes a microprocessor having a memory and a reference table stored in the memory, the reference table including a plurality of speed values each corresponding to a separate angular spacing value, the microprocessor being configured to select a desired speed value based on the sensed angular position.

9. The vibratory system as recited in claim 1 wherein each one of the first and second weights has a center of mass and a centerline extending between the center of mass and the axis, the spacing angle being defined between the centerline of the first weight and the centerline of the second weight.

10. The vibratory system as recited in claim 1:

further comprising a first reference member connected with the first weight and a second reference member connected with the second weight; and wherein the sensor is located at a fixed location with respect to the axis and is configured to generate a signal when either one of the two reference members is disposed generally proximal to the fixed location.

11. The vibratory system as recited in claim 10 wherein each of the first and second reference members is a magnet and the sensor is a proximity sensor configured to sense the magnets.

12. The vibratory system as recited in claim 10 further comprising a handwheel configured to angularly displace the first weight with respect to the second weight, the first reference member being connected with the handwheel.

13. The vibratory system as recited in claim 1 wherein the controller includes a microprocessor electrically coupled with the sensor and with the motor.

14. The vibratory system as recited in claim 1 further comprising a pump operatively coupled with the motor, the controller being operatively connected with the pump and configured to adjust the pump to thereby adjust rotational speed of the motor.

15. The vibratory system as recited in claim 1 further comprising an adjustment mechanism configured to angularly displace one of the first and second weights with respect to the other one of the first and second weights.

16. A control system for a vibratory mechanism of a compacting vehicle, the vibratory mechanism including first and second rotatable members and an actuator configured to rotate the members, the control system comprising:

a sensor configured to sense a spacing angle between the first and second rotatable members; and a controller coupled with the sensor and configured to automatically operate the actuator, the controller automatically operating the actuator to rotate the two members at about a first rotational speed when the spacing distance has a first value and alternatively to rotate the two members generally at about a second rotational speed when the spacing distance has a second value, the first distance being greater than the second distance and the first speed being greater than the second speed.

17. The control system as recited in claim 16 wherein:

the first and second members rotate about an axis extending centrally through the two members;

the sensor is configured to generate a signal when the first rotatable member is disposed at a particular angular position about the axis and to generate another signal when the second member is disposed at the angular position; and the controller is configured to determine the spacing angle using the two signals.

18. The controller as recited in claim 16 wherein the actuator includes a motor configured to rotate the two members and a pump operatively coupled with the motor, the controller being operatively connected with the pump and configured to adjust the pump to thereby adjust rotational speed of the motor.

19. A vibratory system for a compacting vehicle, the vehicle including a frame and at least one compacting drum rotatably connected with the frame, the vibratory system comprising:

first and second weights each disposed within the drum so as to be rotatable about an axis, at least one of the two weights being adjustably positionable about the axis so as to vary a value of a spacing angle between the two weights;

a motor configured to rotate the first and second weights about the axis;

a sensor configured to sense when one of the first and second weights is disposed at a particular angular position about the axis and to generate a corresponding signal; and a controller coupled with the sensor and configured to determine the value of the spacing angle using the signal and configured to adjust the motor, the controller adjusting the motor to rotate the two weights at about a first rotational speed when the spacing angle has a first value and alternatively to rotate the two weights at about a second rotational speed when the spacing angle has a second value.

20. A control system for a vibratory mechanism of a compacting vehicle, the vibratory mechanism including first and second weights rotatable about an axis, at least one of the two weights being adjustably positionable about the axis with respect to the other one of the two weights, and a motor configured to rotate the two weights, the control system comprising:

a sensor configured to sense at least one of the first and second weights; and a controller coupled with the sensor and configured to determine a spacing angle between the first and second members, the controller being further configured to operate the motor, the controller operating the motor to rotate the two weights at a rotational speed having a value that is generally directly proportional to the value of the spacing distance.

* * * * *